US005749024A

United States Patent [19]

Young

[11] Patent Number: 5,749,024

[45] Date of Patent: May 5, 1998

[54] PRINTING SYSTEM FOR AUTOMATICALLY DELIVERING TRANSPARENCIES AND REGULAR SHEETS IN PROPER ORDER WITH DIFFERENT OUTPUT MODULES

[75] Inventor: David K. Young, Fairport, N.Y.

[73] Assignee: Xerox Corporation, Stamford, Conn.

[21] Appl. No.: 846,191

[22] Filed: Apr. 28, 1997

[51] Int. Cl.[6] ..... G03G 21/14

[52] U.S. Cl. ..... 399/85; 399/382; 399/397

[58] Field of Search ..... 399/382, 397, 399/405, 76, 77, 85; 271/278, 1

[56] References Cited

U.S. PATENT DOCUMENTS

| | | | |
|---|---|---|---|
| 4,111,542 | 9/1978 | Mailloux et al. | 355/14 |
| 4,370,052 | 1/1983 | Murakami et al. . | |
| 4,609,282 | 9/1986 | Crandall | 355/3 |
| 4,681,428 | 7/1987 | Devoy . | |
| 4,748,470 | 5/1988 | Ibuchi . | |
| 4,763,161 | 8/1988 | Forest et al. . | |
| 4,949,128 | 8/1990 | Parsons . | |
| 5,136,341 | 8/1992 | Takemura et al. | 355/311 |
| 5,138,373 | 8/1992 | Hoyer | 355/200 |
| 5,177,546 | 1/1993 | Tsubo . | |
| 5,481,353 | 1/1996 | Hicks et al. . | |
| 5,610,700 | 3/1997 | Yoshizuka | 399/45 |
| 5,669,058 | 9/1997 | Ito | 399/382 |

OTHER PUBLICATIONS

Xerox Disclosure Journal, vol. 9, No. 6, Nov./Dec. 1984, p. 397 "Transparency/Master Feature" by: T. Acquaviva.

*Primary Examiner*—R. L. Moses

[57] ABSTRACT

In a reproduction system providing an ordered output from a printer to a sheet output stacker of printed transparency sheets interleaved with corresponding paper sheets, with a choice of different output stacker units to be operatively connected to the printer, wherein at least one stacker provides face down stacking, and at least one other provides face up stacking; an automatic electronic printing order control system is automatically electronically activated by the connection of a stacker unit to the printer to change the ordered output of printed transparency sheets and paper sheets so that the transparency sheets will be ahead of their corresponding paper copy sheets regardless of which stacker is connected to the printer. In this example, paper sheets are outputted followed by their corresponding transparency sheets when a non inverting output unit with face up stacking is connected, and the transparency sheets are followed by their corresponding paper sheets when an output stacker with face down stacking is connected, which in this example is a sheet inverting stacker module.

4 Claims, 2 Drawing Sheets

Figure 1:
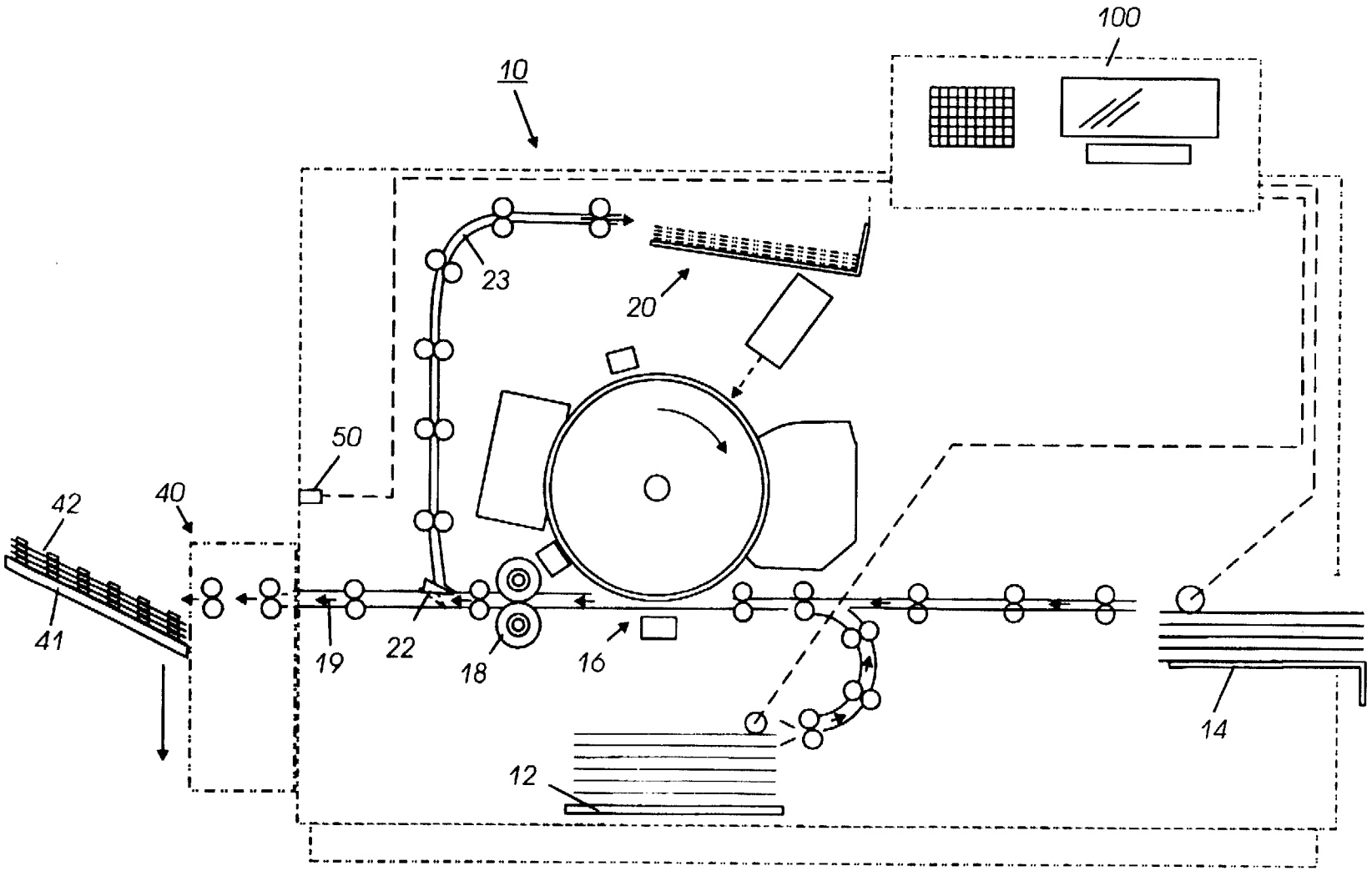

PRINTING SYSTEM FOR AUTOMATICALLY DELIVERING TRANSPARENCIES AND REGULAR SHEETS IN PROPER ORDER WITH DIFFERENT OUTPUT MODULES

Disclosed in the embodiments herein is a system for automatically providing an interleaved print job set of transparency prints and non-transparent paper prints delivered in the proper or desired order to an output stacking tray of a printing machine. More particularly, in which the printing and delivery order of the alternating transparency and paper prints is automatically changed in response to the attachment of a output stacking module with a different stacking orientation than another stacking output (differing in being inverted or not inverted, or face up versus face down stacking).

In reproduction apparatus such as xerographic and other copiers and printers or multifunction machines, it is increasingly important to provide more automatic and reliable handling of the physical image bearing sheets. One desired feature is to provide automatic printing of transparency sheets, also called overhead prints, interleaved with normal paper sheets. By way of background, there is a Vol. 9 No. 6 Nov./Dec. 1984 p. 397 Xerox Disclosure Journal (XDJ) publication by Thomas Acquaviva entitled "TRANSPARENCY/MASTER FEATURE", and a subsequent Eastman Kodak U.S. Pat. No. 4,609,282 issued Sep. 2, 1986 to Robert P. Crandall, on interposing or interdigitating the printing and output of transparency sheets and separating or dividing sheets of paper, by feeding those two different sheets alternately from two different paper or input trays of the printer. It is also known from both these references to optionally print the same image on the transparency sheet and its immediately adjacent separating sheet of paper. Thereby, the printer can automatically produce alternating paper and transparency sheets of the same images stacked in the same output tray. Another patent relating to making ordered sets of transparent and interposed opaque copies is Xerox Corp. U.S. Pat. No. 4,111,542 issued Sep. 5, 1978 to Louis D. Mailloux, et al.

In particular, when such an interleaved printing mode is being used, It is desirable for the transparencies to end up on top of the paper sheets, as the output stack is picked up by the operator, so that the user can see through the transparency to see that the image on the underlying paper sheet aligns with, and is the same as, the image of the overlying transparency. Also, so that the transparency is on top for ease of "overhead" viewer presentations, without requiring manual reordering of the sheets.

Noted of particular interest on the problem of controlling the order of alternating "OHP" (overhead projector)" (transparency) and regular paper sheets when changing from face up to face down output stacking, or in changing from a sort to a non-sort mode, is Mita Industrial Co. Ltd. U.S. Pat. No. 5,136,341 issued Aug. 4, 1992 to Yoshinobu Takemura, et al.. Note, e.g., Col. 2, lines 40 to end, interalia.

The present system solves various of these problems and provides various of these desired features. Furthermore, it does so in the context of solving the different, additional, problem of providing customers with a choice of machine configurations. That is, two or more different outputs or output modules which may be provided for or connected to the same printer, for different customers, or for the same customers at different times.

The disclosed system of the embodiments here automatically causes the printer to change its transparency versus paper sheet feeding and printing order in response to the attachment of a different output module, without requiring any operator manual switch selection between different output trays, so that automatically the transparencies end up on top of their correspondingly printed interleaved paper separating sheets, as the output stack is picked up by the operator, irrespective of the connected output system sheet orientation (inverted or not inverted stacking, or face up versus face down stacking). Nor does the present system require restriction to uncollated or unsorted output of the print job set. Also, this disclosed system does not require any internal transparency sensors or detectors in the paper tray or paper path.

Further by way of background, it is known in general to have a finishing or other module attached to a copier or printer provide control signals from the module to the copier or printer, e.g., allowed U.S. app. Ser. No. 08/280,978 filed Jul. 27, 1994 by Dale Platterter, et al (D/93465), U.S. Pat. No. 5,__. It is also known to provide a docking or connection signal to the machine indicating attachment of the module, via a plug in connection or a magnetic or other connecting switch actuator such as disclosed in Xerox Corp. U.S. Pat. No. 5,138,373 issued Aug. 11, 1992 to August Hoyer. Accordingly, details of that or other suitable module attachment signaling per se need not be redescribed in detail herein.

Likewise, both removable non-inverting stacking trays, and output stacker modules with inverters, such as disk stackers, are also well known and need not be described herein. Examples include Xerox Corp. U.S. Pat. No. 5,409,202 issued Apr. 25, 1995 to Raymond A. Naramore and William E. Kramer, and other art cited therein.

A specific feature of the specific embodiment(s) disclosed herein is to provide in at least one mode of operation an ordered output from a printing apparatus fed to a sheet output stacker of printed transparency sheets interleaved with corresponding paper sheets, wherein said reproduction system provides a choice of different sheet output stackers which may be operatively connected to said printing apparatus, wherein at least one of said sheet output stackers provides face down stacking, and wherein at least one other of said sheet output stackers provides face up stacking; wherein an automatic electronic printing order control system is provided which is automatically electronically activated by said connection of said at least one of said sheet output stackers to said printing apparatus to change said ordered output of printed transparency sheets and paper sheets to automatically select between said output of paper sheets first or said output of transparency sheets first such that said transparency sheets are before their corresponding paper copy sheets for either said output stacker with face down stacking or said output stacker with face up stacking.

Further specific features disclosed herein, individually or in combination, include those wherein said automatic electronic printing order control system is activated to change said ordered output of printed transparency sheets and paper sheets to paper sheets followed by transparency sheets when said output stacker with face up stacking is connected to said printing apparatus and transparency sheets followed by paper sheets when said output stacker with face down stacking is connected to said printing apparatus; and/or wherein said output stacker with face down stacking is a sheet inverting stacker module and said output stacker with face up stacking is a non sheet inverting stacking tray unit which is interchangeable with said sheet inverting stacker module at the same side of said printing apparatus; and/or wherein said ordered output from said printing apparatus is 1 to N order for said output stacker with face down stacking and N to 1 order for said output stacker with face up stacking.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or VLSI designs.

It is well known that the control of document and copy sheet handling systems may be accomplished by conventionally actuating them with signals from a microprocessor controller directly or indirectly in response to simple programmed commands, and/or from selected actuation or non-actuation of conventional switch inputs such as switches selecting the number of copies to be made in that job or run, selecting simplex or duplex copying, selecting a copy sheet supply tray, etc. The resultant controller signals may conventionally actuate various conventional electrical solenoid or cam-controlled sheet deflector gates or fingers, motors or clutches, or other components, in programmed steps or sequences. Also, conventional sheet path sensors or switches connected to the controller may be utilized for sensing, counting, and timing the positions of sheets in the sheet paths of the reproduction apparatus, and thereby also controlling the operation of sheet feeders and inverters, etc., as is well known in the art.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Figure 2:
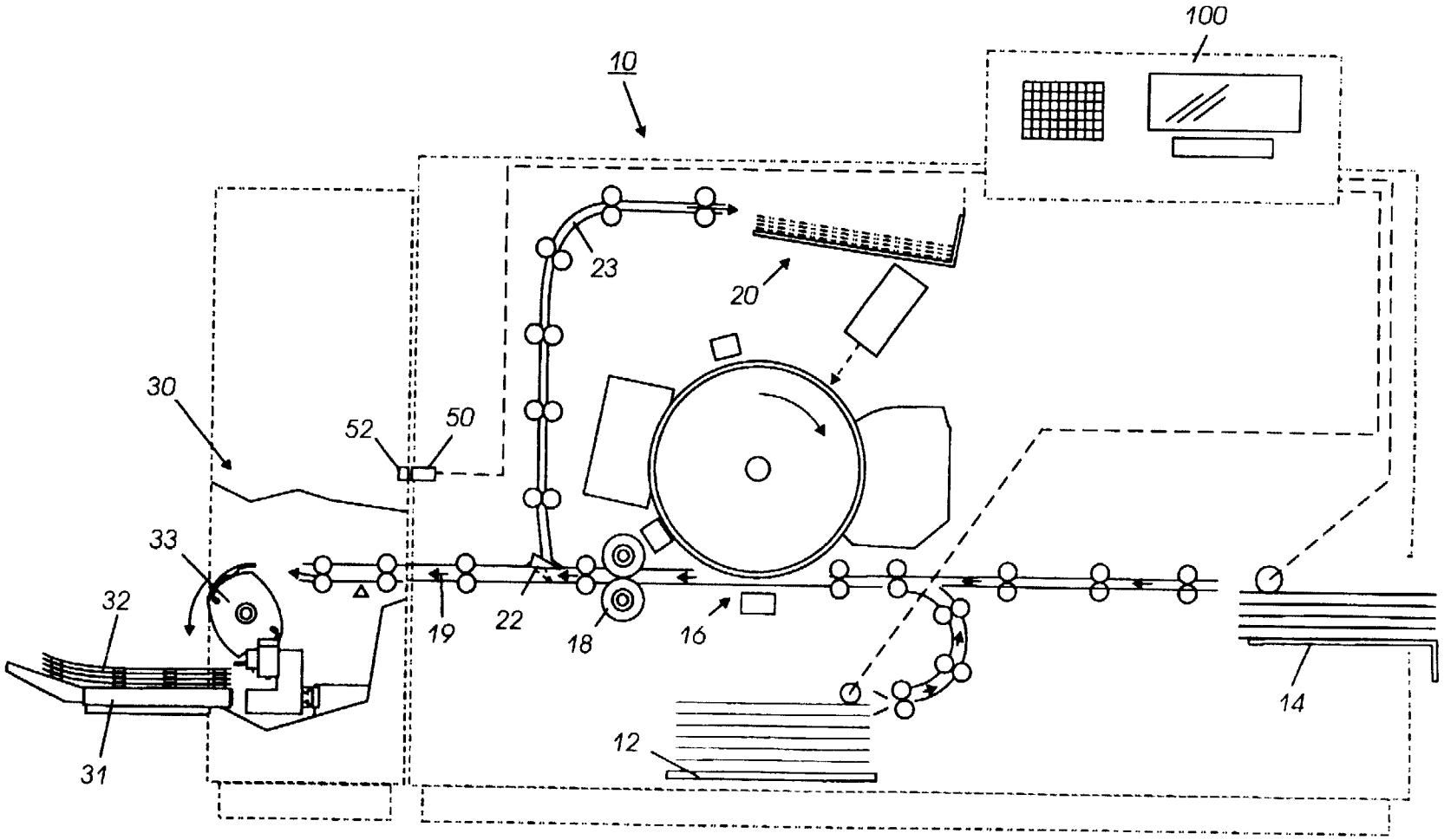

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

FIG. 1 is a schematic frontal view of one embodiment of the disclosed system, with one example of a printer in a configuration with one example of a connected output unit which is here a non-inverting hang-on stacking tray; and FIG. 2 is the same view as FIG. 1, but in an alternate configuration with an alternate output unit comprising a connected output module which is providing inversion before stacking.

Describing now in further detail the exemplary embodiment with reference to the Figures, there is shown a reproduction machine 10, by way of one example of a printing machine with which the present system may be utilized. This particular machine 10 example, a xerographic laser printer, with a programmable controller 100, is merely one example among various otherwise conventional printing machines with which the disclosed system can be used. The machine 10 is one of many capable of interleaved, alternative sheet, printing of transparencies and plain paper sheets, fed alternatively from at least two different paper trays, here trays 12 and 14. Both sheets may be alternately conventionally printed at an image transfer station 16, fused at 18, and then outputted to a selected output or stacking tray for stacking. In this particular machine 10 example, there is a left side straight sheet output path 19 to an optional output stacker module 30 (FIG. 2) or 40 (FIG. 1), to be described. (Although not used in the subject system, the machine 10 itself may also have an integral top stacking tray 20, selectable with a gate 22, having a natural inversion sheet feeding path 23.) Since this particular machine 10 prints sheets face up (prints the top sides of the sheets at transfer station 16), the output path 19 causes sheets to stack face up in tray 41 of module 40, because the printed sheets feed straight out exit path 19 face up. That is, when a non-inverting output stacking tray unit or module such as 40 of FIG. 1 is connected to printer 10, the sheets stack in that output 40 tray 41 face up in a stack 42 in this example.

In contrast, when an inverting stacking module 30 such as shown in FIG. 2 is connected to printer 10, the sheets are inverted, and thus the sheets stack in that output module 30 tray 31 face down in a stack 32, in this example. The exemplary module 30 here is a rotating inverting disks 33 stacker/finisher unit such as that described in detail in the above-cited and other patents thereon.

In this example of FIG. 1 versus FIG. 2, there are thus two different outputs for the printer 10; a first output stacking tray or module 40 with a first simple face-up only output tray 41 (FIG. 1) to which the copy sheets are thus desirably printed and fed in N to 1 order, and a second, alternative output unit 30 (FIG. 2) with an inverter providing face-down stacking 32 in its output tray 31, for which the copies are thus desirably printed and fed in 1 to N order, to provide properly collated output print job sets.

With the present system, the printer controller 100 is automatically signaled as to which of these two different output modules 30 or 40 is attached. In this embodiment example, the connected inverter/stacker module 30 provides an identifying signal to the printer, and the other module 40 does not need to. The subject module attachment identification signal here automatically causes the printer to change its transparency versus paper sheet feeding and printing order, without requiring any operator manual switch selection between different output trays. That module 30 attachment signal in this example is provided by a connection switch 50 in the printer 10, connecting as shown with the controller 100. The switch 50 may be, for example, actuated by an actuator 52 on the module 30, when it is operatively connected, as described in the above cited or other patents thereon.

Re-describing some of the above in other words, it is desired to provide a customer choice or option of a face down inverter/stacker/finisher module 30 at one side of the machine in lieu of the face up stacking tray 40. As explained, here the machine 10 controller 100 desirably automatically self-configures with the mounting of the optional inverter/stacker module 30 versus the unit 40. Preferably, by the stacker module 30 automatically electronically indicating its presence to the machine 10. Preferably, that is accomplished automatically with a stacker module presence or attachment signal such as from a module attachment detector or switch 50. With output to the center or top tray 20 inhibited for overhead prints (OHP), the stacker module 30 presence signal can signal the machine 10 controller 100 to automatically make the correct decision as to whether to send paper prints first or OHP first to the finisher module, so that each transparency is on top of its corresponding paper copy sheet. That is, here, automatically, with no operator input or intervention, changed solely by the actuation of the controller by the module connection signal: paper first, transparency second, repeated, when the face up output system 40 is attached; and transparency first, paper second, repeated, when the face down output system 30 is attached.

To express it another way, the automatic electronic printing order control system here automatically changes the output order of printed transparency sheets and their corresponding paper sheets in response to the type of connected output unit to automatically select between the output of the paper sheet first or the output of the transparency sheet first, such that as the output stack is picked up by the operator from the output tray, the transparency sheet is ahead of its corresponding paper sheet in 1 to N page order, and thus will be on top when the stack is turned face up, for either a connected output stacker with face down stacking and 1 to N page printing order or a connected output stacker with face up stacking and N to 1 page printing order.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a reproduction system providing in at least one mode of operation an ordered output from a printing apparatus fed to a sheet output stacker of printed transparency sheets interleaved with corresponding paper sheets, wherein said reproduction system provides a choice of different sheet output stackers which may be operatively connected to said printing apparatus, wherein at least one of said sheet output stackers provides face down stacking, and wherein at least one other of said sheet output stackers provides face up stacking; wherein an automatic electronic printing order control system is provided which is automatically electronically activated by said connection of said at least one of said sheet output stackers to said printing apparatus to change said ordered output of printed transparency sheets and paper sheets to automatically select between said output of paper sheets first or said output of transparency sheets first such that said transparency sheets are before their corresponding paper copy sheets for either said output stacker with face down stacking or said output stacker with face up stacking.

2. The reproduction system of claim 1 wherein said automatic electronic printing order control system is activated to change said ordered output of printed transparency sheets and paper sheets to paper sheets followed by transparency sheets when said output stacker with face up stacking is connected to said printing apparatus and transparency sheets followed by paper sheets when said output stacker with face down stacking is connected to said printing apparatus.

3. The reproduction system of claim 1 wherein said output stacker with face down stacking is a sheet inverting stacker module and said output stacker with face up stacking is a non sheet inverting stacking tray unit which is interchangeable with said sheet inverting stacker module at the same side of said printing apparatus.

4. The reproduction system of claim 1 wherein said ordered output from said printing apparatus is 1 to N order for said output stacker with face down stacking and N to 1 order for said output stacker with face up stacking.

* * * * *